US005683274A

United States Patent [19]

Straeb et al.

[11] Patent Number: 5,683,274

[45] Date of Patent: Nov. 4, 1997

[54] CONTACT SPRING

[75] Inventors: Martin Straeb, Diessen; Hans-Jost Heimueller, Dudenhofen, both of Germany

[73] Assignee: Siemens Aktiengesellschaft, Munich, Germany

[21] Appl. No.: 645,242

[22] Filed: May 13, 1996

[30] Foreign Application Priority Data

May 11, 1995 [DE] Germany ..... 195 17 353.8

[51] Int. Cl.[6] ..... H01R 4/48

[52] U.S. Cl. ..... 439/839; 439/857

[58] Field of Search ..... 439/839, 847, 439/856, 857; 267/160, 159

[56] References Cited

U.S. PATENT DOCUMENTS 4,540,235 9/1985 Lolic ..... 439/839

5,338,229 8/1994 Egenolf ..... 439/839

FOREIGN PATENT DOCUMENTS 4034941 9/1991 Germany ..... 439/839

*Primary Examiner*—Peter M. Poon

*Attorney, Agent, or Firm*—Herbert L. Lerner; Laurence A. Greenberg

[57] ABSTRACT

A contact spring includes a base spring including a spring arm base having two ends, two parallel side walls with ends, a connection part extending integrally away from the side walls at one end of the spring arm base, and spring arms extending integrally away from the side walls at the other end of the spring arm base. An overspring is retained on the spring arm base and has a bottom wall spanning the side walls of the spring arm base, and side walls peripherally adjoining the bottom wall, being parallel to the side walls of the spring arm base and extending around the ends of the side walls of the spring arm base. The base spring, in the vicinity of the spring arm base, and the overspring each having a top with at least one shaped tab joined to one of the side walls. One of the shaped tabs is retained by snapping under or underlapping another of the shaped tabs, forming a clamping device for securing the overspring and the base spring against mutual slippage.

15 Claims, 3 Drawing Sheets

C-C

CONTACT SPRING

BACKGROUND OF THE INVENTION

Field of the Invention

The invention relates to a contact spring including a base spring having a spring arm base from which a connection part on one end and spring arms on the other extend integrally away from two parallel side walls of the spring arm base, an overspring being retained on the spring arm base and having a bottom wall spanning the side walls of the spring arm base, the bottom wall being adjoined peripherally by respective side walls being disposed parallel to the side walls of the spring arms and extending around the ends of the side walls, and a clamping device for securing the overspring and the base spring against mutual slippage.

Such contact springs are described, for instance, in German Utility Model DE-GM 92 02 365.7 and are preferentially used widely as plug connectors in automotive engineering. In those contact springs, the overspring essentially has the function of increasing the spring force of the contact spring and, by being formed with one or more detent tongues, has the function of enabling a releasable locking of the contact spring in a contact chamber of a housing of insulating material. As a rule, the overspring is made of a material with good spring properties, while the base spring is made of a material with good electrical and thermal properties. By way of example, the overspring may be made as a stamped and bent sheet-metal part. The base spring is preferably also a stamped and bent part, but because of the required good electrical properties it preferably is formed of a copper alloy, such as tin-plated brass.

An important feature of such contact springs is that the overspring be securely fastened to the base spring. That is, when an insertion or withdrawal force is exerted, the overspring must avoid relative displacement between the overspring and the base spring, or preclude such an action from being tripped.

In the known contact springs, the fixation of the overspring, fitted over the base spring, is accomplished by bending over special retaining arms or tabs that are formed onto the overspring. In the insertion direction, a bead pressed into the overspring and engaging an element of the base spring from behind prevents the overspring, upon the exertion of the insertion force or a tensile force on the cord, from sliding away from the base spring.

A problem in that known solution is that tilting of the overspring causes a reduction in an overcut between the bead and the end wall of the tab of the base spring, thus threatening the retention function. Moreover, the tab of the base spring uses up material, so that the developed view and thus the spacing, on the stamping strip from which the base spring is stamped out, for the base spring is increased. When the fixation of the base spring and the overspring is accomplished through the use of a tab and a bead, the tab alone in fact claims about 16% of the width of the necessary stamping part.

Another way of mutually securing the overspring and the base spring of contact springs against slippage is disclosed by German Patent DE 32 48 078 C2. There, the spring arm base of the base spring is likewise box-like in cross section. However, in that device, the spring arm base on the upper edges of its side walls has integrally formed-on top parts, which are each bent over toward the respective side wall, pointing toward one another, by 90°. Located between those two top halves, for reasons of production, is a continuous slit extending along the lengthwise axis of the base spring. It is widened in the direction pointing toward the connection part by cutting out a right angle from each top part, with the right angle cutout pointing toward the connection part. That produces an approximately rectangular opening in the entire top part of the base spring, which can be engaged from behind by a detent tongue of a box-like overspring that is fitted over it.

A problem in that device is the box-like construction of the base spring, which takes up a relatively large amount of material. Moreover, in that known device, only a single detent tongue can be made, which serves to lock the base spring and the overspring unit in a contact chamber of an associated housing. The force needed to undo such a lock with only a single detent tongue is therefore substantially less than in contact springs having two detent tongues. Contact springs with two detent tongues are more often preferred, for that reason.

In the known contact spring contacts, there is also an increasing demand for two independently acting securing principles, which necessitate both a special structure of the contact spring contact acting as a bush contact and of the plug contact belonging to it.

In addition to so-called primary locking, a secondary securing device of the contact spring contact into which the plug contacts are plugged is demanded. Once the contact springs have been plugged into associated housings made of insulating material (plug strips, relay socket, etc.), detent elements engage corresponding openings of those housings and lock into place there.

The secondary securing device is currently achieved by providing that after the housings have been assembled and the contact spring contacts have undergone primary locking, plastic elements are put into a position in which they engage the contour of the contact from behind. Usually, because of an asymmetrical geometry of the contact spring, that is possible on only one side of those contacts.

In cases where space is tight, it is usually difficult to construct the secondary securing device in such a way that it acts on both short sides of a contact array constructed as a contact chamber. In order to assure its function, it has therefore been necessary until now to insert the contact spring contact positionally correctly into the plastic housing provided with a contact array. That positionally correct introduction of the contact spring contact leads in practice to assembly problems in particular. That problem becomes all the more difficult with the use of symmetrically constructed contact arrays into which the contact spring contacts are introduced.

At present, both asymmetrically and symmetrically constructed contact arrays for contact spring contacts are known. However, the symmetrical contact arrays offer possibilities of engagement for a secondary securing device only on two of their outer sides. However, the associated contact spring contact of such symmetrical contact arrays can be inserted only in a certain orientation, or the possibility also exists of inserting them rotated by 180°.

SUMMARY OF THE INVENTION

It is accordingly an object of the invention to provide a contact spring, which overcomes the hereinafore-mentioned disadvantages of the heretofore-known devices of this general type and which furnishes secure fixation of a base spring and an overspring, with a required expenditure of material therefor being reduced in comparison with known contact springs. It should also be possible to provide a secondary securing device that engages all sides.

With the foregoing and other objects in view there is provided, in accordance with the invention, a contact spring, comprising a base spring including a spring arm base having two ends, two parallel side walls with ends, a connection part extending integrally away from the side walls at one end of the spring arm base, and spring arms extending integrally away from the side walls at the other end of the spring arm base; and an overspring being retained on the spring arm base and having a bottom wall spanning the side walls of the spring arm base, side walls peripherally adjoining the bottom wall, being parallel to the side walls of the spring arm base and extending around the ends of the side walls of the spring arm base; and the base spring, in the vicinity of the spring arm base, and the overspring each having a top with at least one shaped tab joined to one of the side walls, and one of the shaped tabs being retained by snapping under or underlapping another of the shaped tabs, forming a clamping device for securing the overspring and the base spring against mutual slippage.

Due to the undersnapping mounting of one shaped tab on the other shaped tab, a secure hold of the overspring and base spring is attained even if the overspring tips sideways relative to the base spring in respect to external factors.

The shaped tab of the overspring is preferably constructed to be self-locking. According to a preferred feature of the invention, the shaped tab of the overspring, upon mounting of the contact spring, engages the shaped tab of the base spring, which tab is preferably constructed as a hoop. As a result, the self-locking tabs of the overspring upon being joined are bent elastically, and they snap back (which is referred to herein as underlapping and undersnapping) into an outset position after locking in place. When the contact spring is installed, the base spring is preferably inserted into the pre-bent overspring. Next, the side walls of the overspring are bent to the desired or set-point size, and the shaped tab or tabs located on it are pressed inward. As a result of undersnapping of parts of the shaped tabs of the overspring under the shaped tabs of the base spring, a form-locking arrest is provided, which assures a secure clamping of the overspring and the base spring.

In accordance with another feature of the invention, both the base spring and the overspring, each on the top, have two inward-pointing shaped tabs pointing in opposite directions from one another, one shaped tab each of the overspring is held to undersnap or underlap an opposed shaped tab of the base spring. Since two such shaped tabs each are provided, even better clamping of the overspring and the base spring is achieved. If one of the shaped tabs breaks for whatever reason, for instance, or if one of these shaped tabs is bent wrong in such a way that undersnapping with the opposed shaped tab is no longer possible, then an adequately secure fixation of the overspring to the base spring is still possible because of the possibility of undersnapping with the other two shaped tabs.

In accordance with a further feature of the invention, each shaped tab of the base spring extends orthogonally away from the edge of a side wall that extends parallel to the lengthwise axis of the contact spring on the top. The shaped tab or tabs of the overspring are thus disposed jointly on the top of the overspring and upon installation can be pressed in a simple way into the box-like interior of the overspring.

In accordance with an added feature of the invention, each shaped tab of the base spring, on its side intended for the snap connection to the associated shaped tab of the overspring, is provided with a guide device.

In accordance with an additional feature of the invention, the guide device is an embossed feature, which is mounted on the shaped tabs of the overspring.

In accordance with yet another feature of the invention, for this purpose, each shaped tab of the overspring has a shaped tab part oriented in the manner of a top wall toward the side wall, which on the end provides a shaped tab plate, having a plane of the plate which is disposed essentially orthogonal to the lengthwise axis of the contact spring. The aforementioned embossed feature is disposed on the distal end of this shaped tab plate, so that when pressure is exerted into the snapping position, the associated shaped tab of the overspring is pressed beneath the shaped tab of the base spring.

In accordance with yet a further feature of the invention, the spring arm base of the base spring is constructed without a bottom, and the overspring has at least one tab which is clamped between the side walls of the spring arm base of the base spring. As a result, a laterally slip-free connection, with respect to the lengthwise axis of the contact spring, of the overspring and base spring is attained.

In accordance with yet an added feature of the invention, the last-mentioned tab of the overspring may, for instance, be constructed at least approximately semicircular and have an outer diameter that is approximately equivalent to the spacing between the side walls of the spring arm base of the base spring, and is bent over from the bottom wall of the overspring inward at least approximately at a right angle between the side walls of the spring arm base of the base spring. Preferably, two such spaced-apart tabs are disposed in the bottom wall of the overspring and bent inward between the side walls of the spring arm base of the base spring.

Along with the prevention of lateral slippage of the overspring relative to the base spring, thanks to this tab being bent inward into the interior of the contact spring a mechanically stable structure of the contact spring is achieved, since the side walls can be braced against this inwardly bent tab.

In accordance with yet an additional feature of the invention, the side walls of the overspring, in the mounted state of the contact spring, rest flatly on the outside against the side walls of the spring arm base of the base spring. This provision further increases the stability of the entire contact spring.

In accordance with a concomitant feature of the invention, the overspring is constructed in box-like fashion, at least on its end toward the connection part, and with this end protrudes past the spring arm base of the base spring. The result is a possibility for engagement by the secondary securing device on all four sides of the overspring and thus of the contact spring. A suitable plastic element can thus be simply put on all sides into a position that engages the contour of the box-like end of the overspring from behind. Since the rib that joins the connection part to the spring arm base of the contact spring extends approximately centrally out of the box-like end of the overspring, the four-sided capability of engagement for the secondary securing device on the overspring exists without requiring any further provisions.

Other features which are considered as characteristic for the invention are set forth in the appended claims.

Although the invention is illustrated and described herein as embodied in a contact spring, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
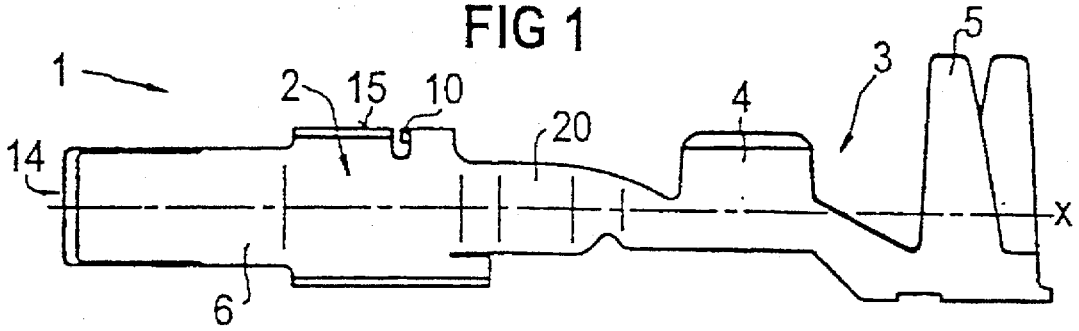
FIG. 1 is a side-elevational view of a base spring of a contact spring of the invention with spring arms, a spring arm base and a connection part.
Figure 2:
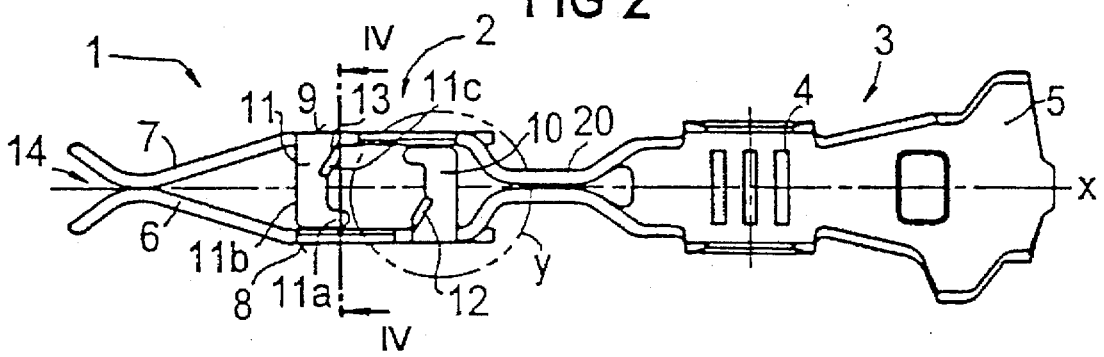
FIG. 2 is a plan view of the base spring of FIG. 1, showing an upper surface of the base spring.

Referring now in detail to the figures of the drawings, in which identical reference numerals, unless otherwise indicated, represent identical parts with the same meaning, and first, particularly, to FIGS. 1 and 2 thereof, there is seen a base spring 1 for a contact spring according to the invention which is shown as an example, both in a side view and in a plan view of an upper surface of the base spring 1. The base spring 1 is formed of a material with good electrical and thermal properties, such as spring bronze, and essentially has a connection part 3 with an insulating claw 5 and an integrally appended conductor claw 4. A rib 20 is integrally formed onto the conductor wire claw 4 and on its opposite end merges into a spring arm base 2. The spring arm base 2 substantially includes two spaced-apart side walls 8, 9, extending parallel to a lengthwise axis X of the contact spring. Respective shaped tabs 10, 11 to be described in further detail below are integrally bound on each of top edges thereof. In addition, in contrast to the base springs previously known, the spring arm base 2 has no bottom wall. The side walls 8, 9 of the spring arm base 2 of the base spring 1 are thus not integrally joined to one another in the region of the spring arm base.

Two spring arms 6, 7 are attached to the spring arm base 2, opposite the rib 20, and terminate in a known manner in an insertion funnel 14. To that end, the two spring arms 6, 7 extend obliquely toward one another, beginning at the two spaced-apart side walls 8, 9 of the spring arm base 2, and initially touch one another and then diverge again to form the insertion funnel 14. The entire base spring 1 extends along its lengthwise axis X.

Although in the present exemplary embodiment of the base spring 1, the connection part 3 has the conductor wire claw 4 and the insulation claw 5 and thus forms a crimp connection, any other embodiment of the connection part would also be possible. By way of example, the connection part 3 could be constructed as a so-called IDC connection or insulation displacement connection or double IDC connection, and so forth. The only essential feature is the integral binding of the connection part 3 to the spring arm base 2 of the base spring 1 through the rib 20.

As already mentioned, the spring arm base 2 is provided on top with shaped tabs 10, 11. In the exemplary embodiment illustrated in FIGS. 1 and 2, one shaped tab 10, 11 is integrally formed onto edges of each of the two side walls 8, 9. Those edges face toward an upper surface 15 of the base spring 1. The shaped tab 10 is integrally formed onto the side wall 8, and the shaped tab 11 is integrally formed onto the side wall 9. Both shaped tabs 10, 11 have approximately one-fifth the length of the spring arm base 2, relative to the lengthwise axis X of the contact spring. The shaped tab 11 is formed onto the side wall 9 in the front portion of the spring arm base 2 and therefore on the end of the spring arm base 2 facing toward the spring arms 6, 7, while the shaped tab 10 is formed onto the side wall 8 on the opposite end of the spring arm base 2. Both shaped tabs 10, 11 extend toward the opposed side wall 9, 8, specifically in such a way that their surfaces are each orthogonal to the side walls 8, 9 and are in the same plane with one another.

Figure 3:
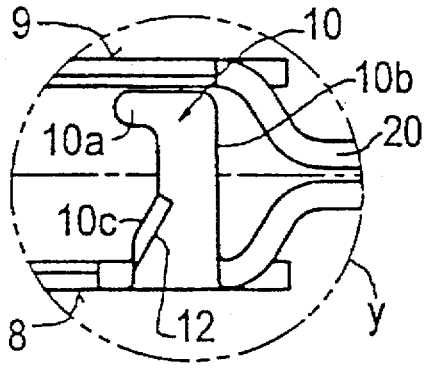
FIG. 3 is an enlarged view of the base spring of FIG. 2 in the vicinity of the spring arm base.

For the sake of greater clarity, the region of the spring arm base 2 outlined in dashed lines in FIG. 2, having the shaped tab 10, is shown separately and enlarged in FIG. 3 so that the details thereof can be seen better. The shaped tab 10 is approximately L-shaped and extends to near the side wall 9.

The shaped tab 10, beginning at the side wall 8, extends first with its long leg in the direction of the side wall 9, then near this side wall 9 it protrudes at a right angle in the direction of the spring arms 6, 7 and ends in a protrusion 10*a*. An embossed feature 12 or guide device is disposed at a transition between the side wall 8 and the shaped tab 10, on the side of the shaped tab 10 remote from the rib 20 of the base spring 1, and the shaped tab 10 is widened by an incline in this region. This incline is indicated by reference numeral 10*c* in FIG. 3. An opposite boundary of the shaped tab 10 is indicated by reference numeral 10*b* and extends in a straight line. This boundary 10*b* is also orthogonal to the side wall 8.

The contour of the shaped tab 10 on the side facing toward the spring arms 6, 7 is essential for the clamping device which is to be explained below and with which an overspring 30 shown in FIGS. 5–8 can be secured to the spring arm base 2.

The shaped tab 11 attached to the side wall 9 is constructed similarly to the shaped tab 10. However, as can be seen from FIG. 2, a protrusion 11*a* is oriented toward the connection part 3 of the contact spring, as is an embossed feature 13 or guide device. Conversely, a boundary 11*b* of the shaped tab 11 is oriented toward the spring arms 6, 7.

Figure 4:
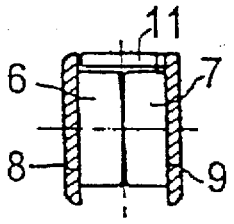
FIG. 4 is a sectional view of the base spring of FIG. 2, which is taken along a line C—C of FIG. 2, in the direction of the arrows.

FIG. 4 shows an associated sectional view taken along the section line C—C of FIG. 2 in the region of the spring arm base 2. As can be seen clearly, the spring arm base 2 is constructed without a bottom. In other words, there is no bottom wall between the two side walls 8, 9. In FIG. 4, next to the two spring arms 6, 7 extending toward one another, it is also possible to see the shaped tab 11 which is attached to the side wall 9, which is orthogonal to the two side walls 8, 9 and which ends shortly before the side wall 8.

In the ensuing FIGS. 5–8, an overspring 30 is shown by way of example. This overspring 30 may be mounted in clamping fashion onto the base spring 1 shown in FIGS. 1–4. The overspring 30 is also known as a detent sleeve. As can be seen from FIGS. 5–8, the overspring 30 is constructed to be approximately box-like around the lengthwise axis X. The overspring 30 is formed of a material with good spring properties, such as a stamped and bent sheet-metal part.

The box-like overspring 30 includes a bottom wall 33, having two edges extending parallel to the lengthwise axis X, from which side walls 31, 32 extend in the same direction, parallel to one another. One respective detent tongue 34, 35 is machined into each of these side walls 31, 32. Moreover, one respective clamp arm 40, 41 extends in the same direction away from each of these side walls 31, 32. In the exemplary embodiment of FIG. 5, these clamp arms 40, 41 extend away from the left-hand edge of the side walls 31, 32 and converge toward one another. These clamp arms 40, 41 are intended to press with their respective ends against the spring arms of the base spring and thus to assure an increased clamping force of the spring arms of the base spring.

Figure 6:
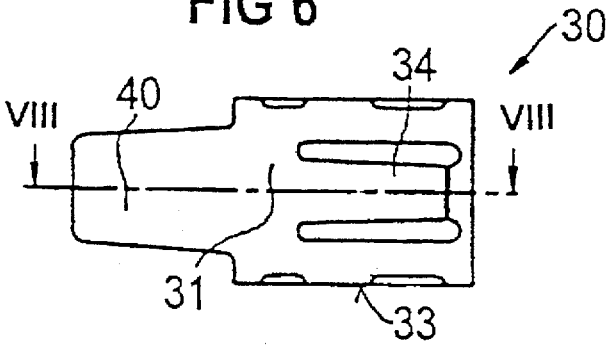
FIG. 6 is a side-elevational view of the overspring shown in FIG. 5.
Figure 8:
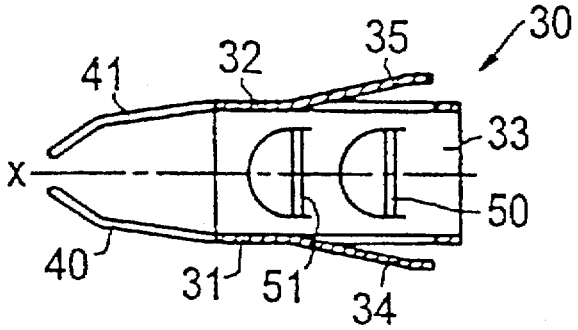
FIG. 8 is a sectional view of the overspring, which is taken along a line B—B of FIG. 6, in the direction of the arrows.

As can be seen from the sectional view of FIG. 8, which is taken along the section line B—B of FIG. 6, two spaced-apart semicircular notches have been machined into the bottom wall 33. Semicircular tabs are bent out of these notches into the interior of the inner spring. These tabs are identified by reference numerals 50, 51. Surfaces of these tabs 50, 51 are orthogonal to the lengthwise axis X.

Respective shaped tabs 36, 37 which are integrally formed onto each of the two side walls 31, 32 of the overspring 30 cooperate with the shaped tabs 10, 11 of the base spring 1, described in conjunction with FIGS. 1–4, in order to assure a clamping hold of the overspring 30 on the spring arm base 2 of the base spring 1.

Figure 5:
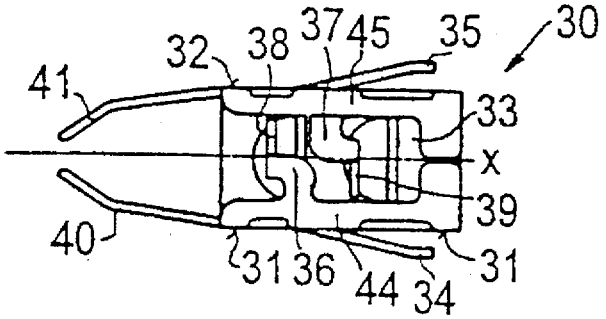
FIG. 5 is a plan view of a top wall of an exemplary overspring.
Figure 7:
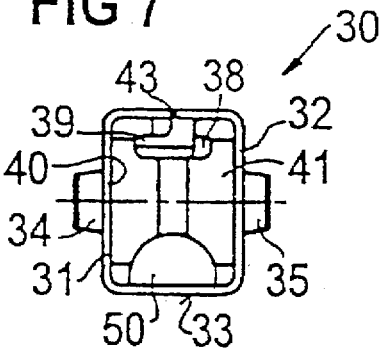
FIG. 7 is an end-elevational view of the overspring shown in FIGS. 5 and 6 showing a box-like interior of the overspring, as seen from the side of the connection part of the contact spring.

As FIGS. 5 and 7 clearly show, the shaped tabs 36, 37 are constructed as follows. Integral narrow top parts 44, 45, extending parallel to the lengthwise axis X, are formed onto the edges of the side walls 31, 32 opposite the bottom wall 33. These top parts 44, 45 are perpendicular to the respectively attached side wall 31, 32. The top parts 44, 45 are located in the same plane, as FIG. 7 shows, and are oriented in such a way as to point toward one another. The shaped tab 37 is integrally formed approximately centrally onto the top part 45. This shaped tab 37 initially extends in the direction of the opposite side wall 31, and then bends at a right angle approximately halfway along the width of the overspring 30 and then continues in the opposite direction toward the clamp arms 40, 41. On its end, this shaped tab 37 terminates in a shaped tab plate 39, which is oriented orthogonally to the lengthwise axis X. The shaped tab 37 with its shaped tab plate 39 is disposed on the overspring 30 precisely in such a way that in the mounted state of the contact spring, in other words where the overspring 30 is fitted over the spring arm base 2 of the base spring 1, it can come into clamping engagement with the shaped tab 10. This will be described below in conjunction with FIGS. 9–11 as well.

The shaped tab 36 is constructed similarly to the shaped tab 37, but is integrally attached to the side wall 31. To that end, the narrow top part 44 is likewise integrally formed onto the edge of the side wall 31 opposite the bottom wall 33. This top part 44 is adjoined integrally by the shaped tab 36, which extends initially away from the top part 44 toward the opposite side wall 32, then halfway across the width of the overspring 30 bends at a right angle toward the clamp arms 40, 41. The shaped tab 36 again ends in a shaped tab plate 38, which is orthogonal to the lengthwise axis X. The entire shaped tab 36 is attached to the side wall 31 or to the top part 44 in such a way that the shaped tab plate 38 can enter into clamping engagement with the shaped tabs 11 of the base spring 1, which are shown in FIGS. 1–4.

As can be seen from the plan view of FIG. 7, the shaped tab plates 38, 39 are L-shaped, for example, and are provided on their lower surface with an embossed or stamped feature 43 acting as an insertion aid. Essentially, this embossed feature 43 is an incline, which acts as a guide in an undersnapping or underlapping of the shaped tabs 36, 37 beneath the shaped tabs of the base spring 1.

Figure 9:
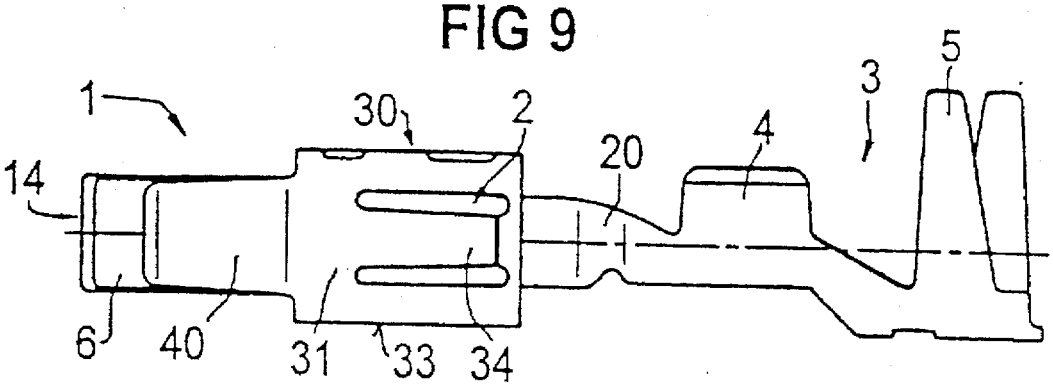
FIG. 9 is a side-elevational view of a complete contact spring with the base spring and the overspring of FIGS. 1–8.
Figure 10:
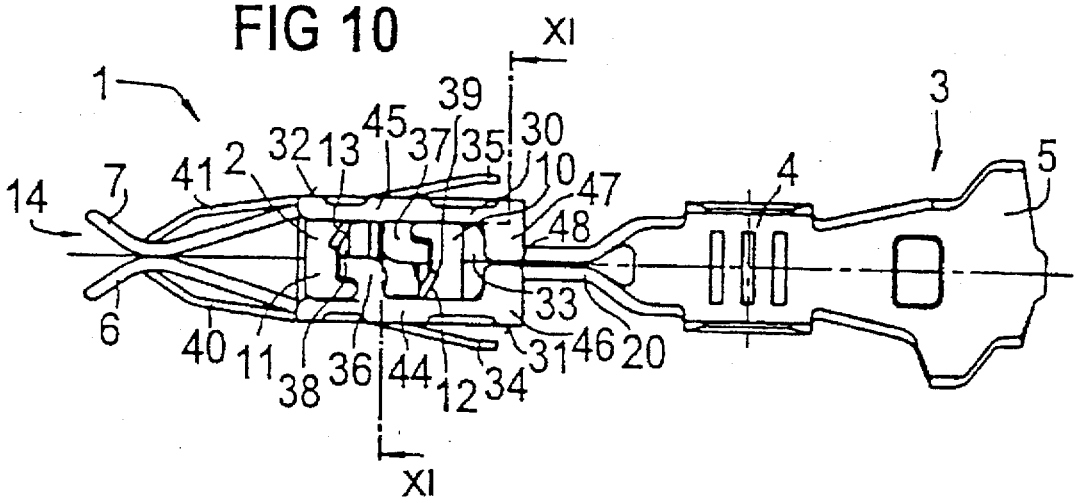
FIG. 10 is a plan view of the complete contact spring of FIG. 9 showing the top wall of the base spring.
Figure 11:
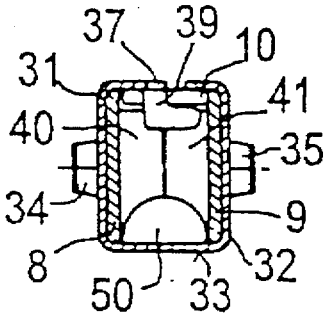
FIG. 11 is a sectional view of the contact spring which is taken along a line C—C of FIG. 10, in the direction of the arrows.

In FIGS. 9, 10 and 11, the completely mounted contact spring is shown, with the base spring 1 and with the overspring 30 fitted over the spring arm base 2 of the base spring 1, in a side view in FIG. 9, a plan view in FIG. 10, and a sectional view along the line C—C of FIG. 10 in FIG. 11. The reference numerals already used above stand for the same parts in this case as well.

As is particularly seen from FIGS. 10 and 11, the shaped tab plates 38, 39 undersnap or underlap the respective shaped tabs 11 and 10 of the spring arm base 2 of the base spring 1. The shaped tab plates 38, 39 underlap or undersnap the shaped tabs 11 or 10 precisely at the points where the shaped tabs 10, 11 are provided with the inclines or embossed features 12, 13. Upon contact assembly, the base spring 1 is placed in the partially pre-bent overspring 30. Next, the side walls 31, 32 of the overspring 30 are bent to a set-point dimension, and the shaped tabs 36, 37 located on it are pressed inward. Form-locking arresting of the overspring 30 and the base spring 1 is achieved by undersnapping of the shaped tab plates 38, 39, which is facilitated by the aforementioned embossed features 12, 13 and 43, respectively, beneath the shaped tabs 10, 11 of the base spring 1.

As is shown particularly in FIG. 10, the top parts 44, 45 of the overspring 30 are provided on ends thereof facing toward the connection part 3, with widened tabs 46, 47, each of which protrude approximately to the center of the overspring 30. The two tabs 46, 47 are separated from one another by a slit 48. On the end of the overspring 30 facing toward the connection part 3, this produces a box-like structure of the overspring 30 with a quadrilateral boundary edge. Due to this end, the overspring 30 protrudes beyond the spring arm base 2 of the base spring 1. Once the contact spring is mounted, the rib 20 of smaller dimensions protrudes approximately centrally out of the box-like overspring 30. Since the rib 20, as FIG. 9 shows, is constructed to be substantially smaller in its dimensions than the outer encompassing border of the overspring 30, a secondary securing device can engage all four sides of the overspring 30 without requiring further provisions.

As can also be seen from the sectional view of FIG. 11, the side walls 31, 32 rest flatly on the side walls 8, 9 of the base spring 1. The tabs 50, 51 (the tab 51 cannot be seen in FIG. 11) peripherally border on the side walls 8, 9, as a result of which the overspring 30 is protected against lateral slippage.

Although the description in the present exemplary embodiment has consistently said that two shaped tabs of the overspring undersnappingly or underlappingly engage two shaped tabs of the base spring, it is possible at any time to provide only a single shaped tab on the base spring or the overspring, instead of two shaped tabs on the base spring or overspring. Nor is it absolutely necessary for the shaped tabs of the overspring to undersnap or underlap the shaped tabs of the base spring. It would be equally possible for the shaped tab or shaped tabs of the base spring to undersnap the shaped tab or shaped tabs of the overspring. What is essential in the sense of the present invention is merely a clamping device constructed in such a way that both the base spring in the region of the spring arm base and the overspring are each provided on the top with at least one shaped tab down to one pair of the side walls or another pair of the side walls, and for one of these two shaped tabs to be rettained in undersnapping or underlapping fashion on the other shaped tab.

We claim:

1. A contact spring, comprising:

a base spring including a spring arm base having two ends, two parallel side walls with ends, a connection part extending integrally away from said side walls at one end of said spring arm base, and spring arms extending integrally away from said side walls at the other end of said spring arm base; and an overspring being retained on said spring arm base and having a bottom wall spanning said side walls of said spring arm base, side walls peripherally adjoining said bottom wall, being parallel to said side walls of said spring arm base and extending around said ends of said side walls of said spring arm base; and said base spring, in the vicinity of said spring arm base, and said overspring each having a top with at least one shaped tab joined to one of said side walls, and one of said shaped tabs being retained at another of said shaped tabs, forming a clamping device for securing said overspring and said base spring against mutual slippage.

2. The contact spring according to claim 1, wherein said one shaped tab snaps under said other shaped tab.

3. The contact spring according to claim 1, wherein said one shaped tab underlaps said other shaped tab.

4. The contact spring according to claim 1, wherein said at least one shaped tab includes two respective inward-pointing shaped tabs pointing in opposite directions from one another at said top of said base spring and at said top of said overspring, and each of said shaped tabs of said overspring is held for snapping under a respective one of said opposed shaped tabs of said base spring.

5. The contact spring according to claim 1, wherein said at least one shaped tab includes two respective inward-pointing shaped tabs pointing in opposite directions from one another at said top of said base spring and at said top of said overspring, and each of said shaped tabs of said overspring is held for underlaping a respective one of said opposed shaped tabs of said base spring.

6. The contact spring according to claim 1, wherein said side walls of said spring arm base have edges extending parallel to a lengthwise contact spring axis on the top, and said at least one shaped tab of said base spring extends orthogonally away from said edge of one of said side walls.

7. The contact spring according to claim 6, wherein said one shaped tab snaps under said other shaped tab in a snap connection, said at least one shaped tab of said base spring has a side intended for said snap connection to said shaped tab of said overspring, and said side has a guide device.

8. The contact spring according to claim 7, wherein said guide device is an embossed feature.

9. The contact spring according to claim 1, wherein said at least one shaped tab of said overspring has a shaped tab part oriented like a top wall toward one of said side walls of said overspring, and said at least one shaped tab of said overspring has an end with a shaped tab plate having a plane disposed essentially orthogonal to a lengthwise contact spring axis.

10. The contact spring according to claim 9, wherein said one shaped tab snaps under said other shaped tab in a snap connection, and said shaped tab plate has surfaces and an embossed feature on one of said surfaces for guidance of said snap connection.

11. The contact spring according to claim 1, wherein said spring arm base of said base spring is bottomless, and said overspring has at least one tab being clamped between said side walls of said spring arm base of said base spring.

12. The contact spring according to claim 11, wherein said side walls of said spring arm base of said base spring are spaced apart by a given spacing, and said at least one tab of said overspring is at least approximately semicircular, has an outer diameter being approximately equivalent to said given spacing and is bent over from said bottom wall of said overspring inward at least approximately at a right angle between said side walls of said spring arm base of said base spring.

13. The contact spring according to claim 11, wherein said at least one tab of said overspring is two spaced-apart tabs in said bottom wall of said overspring being bent inward between said side walls of said spring arm base of said base spring.

14. The contact spring according to claim 1, wherein said side walls of said overspring rest flatly on the outside against said side walls of said spring arm base of said base spring, in a mounted state of the contact spring.

15. The contact spring according to claim 1, wherein said overspring has ends including a box-like end facing toward said connection part and protruding past said spring arm base of said base spring.

* * * * *